US005388661A

United States Patent [19]

Hood, Jr.

[11] Patent Number: 5,388,661

[45] Date of Patent: Feb. 14, 1995

[54] SAFETY STRAP FOR SECURING A BODY HARNESS TO A SCAFFOLDING STRUCTURE

[75] Inventor: Roy Hood, Jr., Holden, La.

[73] Assignee: Cherokee Construction Co., Baton Rouge, La.

[21] Appl. No.: 147,343

[22] Filed: Nov. 3, 1993

[51] Int. Cl.[6] ..... A62B 35/00

[52] U.S. Cl. ..... 182/3; 182/129

[58] Field of Search ..... 182/3–7, 182/36, 129, 179, 178

[56] References Cited

U.S. PATENT DOCUMENTS

| | | | |
|---|---|---|---|
| 1,300,040 | 4/1919 | Stuart | 182/4 |
| 1,925,888 | 9/1933 | Weiss | 182/4 |
| 2,606,727 | 8/1952 | De Haven | 182/3 |
| 3,860,089 | 1/1975 | Huggett | 182/4 |
| 4,991,689 | 2/1991 | Cole | 182/3 |
| 5,156,233 | 10/1992 | Olsen et al. | 182/3 |

*Primary Examiner*—Alvin C. Chin-Shue

[57] ABSTRACT

A means for securing a body harness to a scaffolding structure. More particularly, the present invention relates to a strap which: (a) has secured to one end a connection means for attaching to a scaffolding structure of the type which is assembled by a coordinating connection/retention system, such as a locking cup system, and (b) has secured to the other end a mounting ring for attaching to a body harness.

5 Claims, 2 Drawing Sheets

SAFETY STRAP FOR SECURING A BODY HARNESS TO A SCAFFOLDING STRUCTURE

FIELD OF THE INVENTION

The present invention relates to a means for securing a body harness to a scaffolding structure. More particularly, the present invention relates to a strap, having two ends, which: (a) has secured to one end a connection means for attaching to a scaffolding structure of the type which is assembled by a coordinating connection/retention system, such as a locking cup system, and (b) has secured to the other end a mounting ring for attaching to a body harness.

BACKGROUND OF THE INVENTION

Manufacturers of scaffolding safety equipment, as well as builders and users of scaffolding structures, are continually seeking ways of increasing the safety of workers using such structures. One type of safety equipment which is presently used on scaffolding structures is a body harness. The body harness, which is worn by a worker on a scaffolding, is typically secured to the scaffolding structure by use of a lanyard, or strap, to prevent the worker from suffering a serious fall. The lanyard, or strap, usually terminates at opposing ends in a pair of snap hooks. One end is hooked to the body harness. The other end is wrapped around a horizontal scaffolding member and is hooked to itself in such a way that the lanyard is secured around said horizontal member. A representative device is taught in U.S. Pat. No. 4,991,689. While such devices have met with commercial success, there are still situations during use when the snap hook is subject to what is known as "roll out". That is, the lanyard, strap, or ring to which the hook is attached, works free of the hook, leaving the worker in danger of a serious fall.

Therefore, there still remains a need in the art for improved means for securing a body harness to a scaffolding structure, which means will not be subject to "roll out".

SUMMARY OF THE INVENTION

In accordance with the present invention, there is provided a means for securing a body harness to a scaffolding structure of the type which uses a connector/retention system for detachably securing horizontal members to upright members, wherein the upright members contain retention means at vertically spaced locations for receiving connector means secured to ends of horizontal members and wherein said connector/retention system is selected from the group consisting of the wedge-type, the double-ring type, the peg/socket type, the lever/dish type, and the locking cup type, said means for securing a body harness to said scaffolding being comprised of a strap composed of a main body having a first end and a second end, said first end having secured thereto a mounting ring for securing to a body harness and said second end having a connector means secured thereto which can be detachably connected to said retention means of said upright members.

In a preferred embodiment of the present invention, the mounting ring is substantially D-shaped.

In another preferred embodiment of the present invention, the main body of said strap is comprised of a woven, multi-ply, webbing material.

In still another preferred embodiment of the present invention, the connector means is pivotally attached to said main body of the securing means.

In yet another preferred embodiment of the present invention the connector means is of the locking cup type.

BRIEF DESCRIPTION OF THE DRAWINGS

FIG. 2 shows a connection means of the locking cup type; FIG. 3 shows a connection means which is a clamp type, and FIG. 4 shows a connection means of the wedge type.

DETAILED DESCRIPTION OF THE INVENTION

Figure 1:
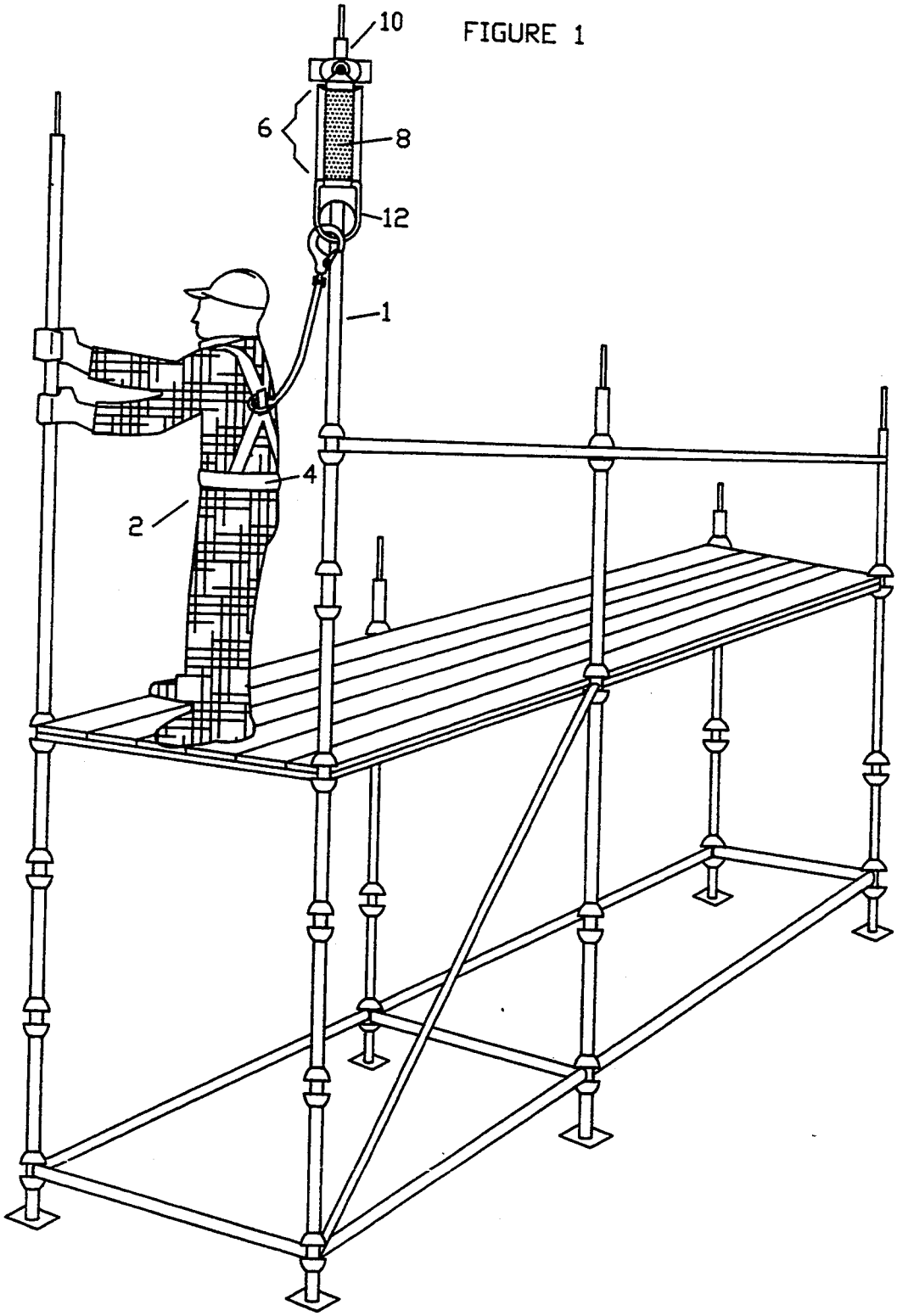
FIG. 1 is a depiction of a worker on a scaffolding structure wearing a body harness which is secured to the structure by a stap of the present invention.

The securing means, or strap of the present invention can be used for securing a body harness to any type of scaffolding structure constructed from tubular members. Preferred scaffolding structures are those which are assembled by use of a coordinated connector/retention system. That is, scaffoldings which are constructed from upright and horizontal tubular members to form a grid-like rigid structure when assembled, wherein one type of tubular member has secured thereto a retention means and the other type of tubular member has secured thereto the corresponding connection means. Typically, the upright members will contain the retention means which will be vertically spaced along their length. The horizontal members, which generally have two ends, have the coordinating connector means secured to each end. The connector means are such that they can be detachably connected to the corresponding, or coordinating retention means. That is, the retention means is designed to receive a particular type of connector means.

Non-limiting examples of connector/retention systems for which the present invention may be used are the so-called wedge type; the double-ring support type; the peg or spigot/socket type; the dish/lever type; and the locking cup types. The wedge-type connector/retention systems generally include any of those which employ a wedge at the ends of a horizontal member to secure the horizontal members to upright members which contain cooperative retention means, such as a socket or disc which contains cutouts for receiving the wedge. There are various types of wedge designs, such as the wedge/cutout, or disc, design disclosed in U.S. Pat. Nos. 4,493,578; 4,587,786; 4,180,342; and 4,394,095, all of which are incorporated herein by reference. A typical wedge/disc design, such as that disclosed in U.S. Pat. No. 4,587,786, is comprised of discs vertically spaced along the length of the upright members. The discs contain a plurality of radially extending locking cutouts, or apertures, for receiving the wedge, which is typically pivotally attached to the ends of the horizontal members. The ends of the horizontal members are typically horizontally slotted to receive a portion of the disc.

Typical wedge/socket type connector/retention systems are disclosed in U.S. Pat. Nos. 4,619,541; 4,522,527; and 4,083,640, which are also incorporated herein by reference. The wedge/socket system is similar to the wedge/disc system except that socket members are used as retention means along the upright members instead of discs.

A preferred type of connector/retention system is the locking cup system which is manufactured by SGB Group Limited of Surrey, England and which is disclosed in U.S. Pat. No. 3,992,118, also incorporated herein by reference. Such a system is comprised of a connector on each end of the horizontal members such that there is provided oppositely directed tongues projecting laterally therefrom. The upright members have opposed retention elements vertically spaced thereon and adapted to receive said tongues. One retaining element is fixed to the upright member and the other retaining element is movable, in a downward direction, along the upright member with respect to said fixed element. The arrangement is such that after separation of the retaining elements, the downward projecting tongue on each horizontal member can be engaged in the fixed retaining element and the oppositely directed projecting tongues engaged in, and by, the movable retaining element. The upright members will also contain thereon a means for engaging the movable retaining element to clamp it against movement away from the fixed retaining element after the said projecting tongues have been engaged in and by the movable retaining element.

Turning now to FIG. 1, there is provided a depiction of a worker 2 wearing a body harness 4 secured to a scaffolding structure 1. The means by which the worker is secured to the scaffolding structure is by use of strap 6 having a main body 8, a connector means 10, attached to one end of said main body, for connecting to the scaffolding structure, and a mounting ring 12 for attaching to the body harness. The main body 8 will be of a material strong enough to support the weight of worker should a fall occur and strong enough to meet all safety regulation requirements. It is preferred that the main body be comprised of a woven material, more preferably a synthetic polymeric material, such as polypropylene or nylon. It is also preferred that the material of the main body be in the form of a woven, multi-ply, webbing construction.

Figure 2:
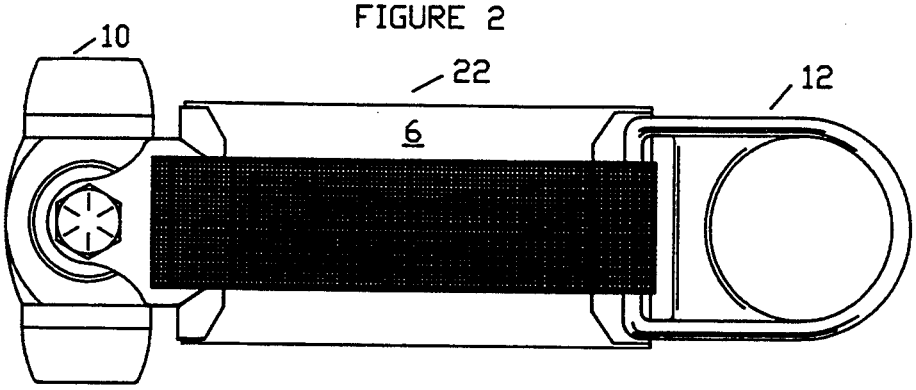
FIGS. 2 to 4 hereof are preferred straps of the present invention having secured thereto various connection means.
Figure 3:
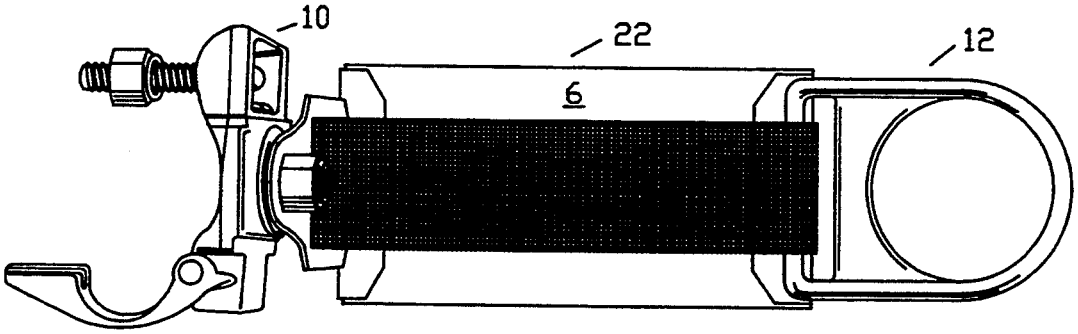
Figure 4:
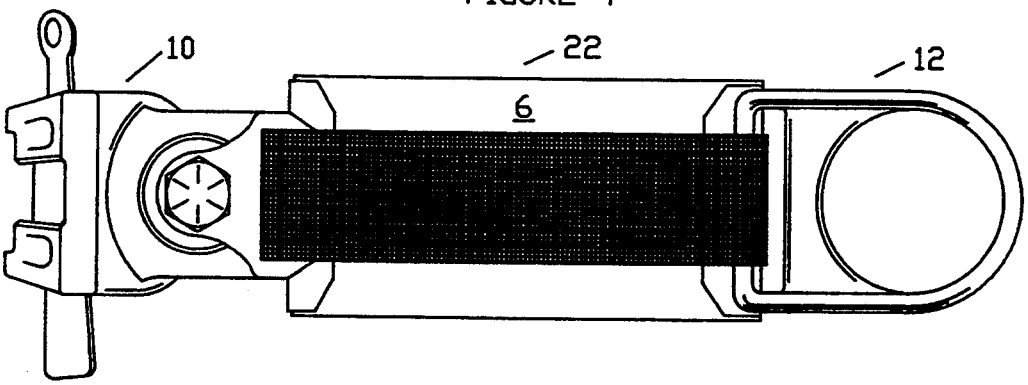

FIGS. 2 to 4 hereof show straps of the present invention, but containing different connector means attached thereto. For example, FIG. 2 shows a strap 6 having main body 22 which is composed of a woven, multi-ply, webbing material. One end of the strap has secured thereto a mounting ring 12, which is preferably substantially D-shaped. This mounting ring will attach to the body harness by any appropriate means, such as by a snap hook. The other end of the stap has secured thereto a connector means 10 for connecting to a corresponding retention means of a scaffolding structure. In this FIG. 2, the connector means is of the locking cup type and will be received by a corresponding retention means on one or more scaffolding members which is designed to receive and securely, but detachably, hold the connector means. It is preferred, as shown in these FIGS. 2 to 4, that the connector means be pivotally attached to the strap. This will allow more freedom of movement for the worker on the scaffolding structure.

FIG. 3 shows a similar strap of the present invention as FIG. 2, except that the connector means is a clamping means. Such a clamping means will merely be secured to a member of the scaffolding structure in appropriate fashion. That is, it will not have a coordinating retention means on one of the scaffolding members. This type of strap is a more universal design which may be used on any scaffolding structure irregardless of the particular type of connector/retention means.

FIG. 4 hereof also shows a similar strap of the present invention as FIG. 2 except the connector means is of the wedge-type connector/retention system. This connector means will be detachably connectable to a corresponding retention means on a scaffolding member.

Various changes and/or modifications, such as will present themselves to those familiar with the art, may be made in the device of the present invention without departing from the spirit of the present invention, whose scope is commensurate with the following claims.

What is claimed is:

1. A means for securing a body harness to a scaffolding structure of the type which uses a connector/retention system for detachably securing horizontal members to upright members, wherein the upright members contain retention means at vertically spaced locations for receiving connector means secured to ends of horizontal members and wherein said connector/retention system is selected from the group consisting of the wedge-type, the double-ring type, the peg/socket type, the lever/dish type, and the locking cup type, said means for securing a body harness to said scaffolding being comprised of a strap composed of a main body having a first end and a second end, said first end having secured thereto a mounting ring for securing to a body harness and said second end having a connector means secured thereto which can be detachably connected to said retention means of said upright members, said connector means being of the type selected from the wedge-type, the double-ring type, the peg/socket type, the lever/dish type, and the locking cup type connector/retention system.

2. The means of claim 1 wherein the main body is comprised of a woven, multi-ply, webbing material.

3. The means of claim 3 wherein the webbing material is selected from the group consisting of polypropylene and nylon.

4. The means of claim 3 wherein the connection/retention system is the locking cup type.

5. The means of claim 3 wherein the mounting ring is substantially D-shaped.

* * * * *